US006739273B2

(12) United States Patent
Orii et al.

(10) Patent No.: US 6,739,273 B2
(45) Date of Patent: May 25, 2004

(54) SEWING MACHINE AND THE SYSTEM THEREOF

(75) Inventors: Akira Orii, Tokyo (JP); Takeshi Kongo, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 161 days.

(21) Appl. No.: 09/929,285

(22) Filed: Aug. 15, 2001

(65) Prior Publication Data

US 2002/0026887 A1 Mar. 7, 2002

(30) Foreign Application Priority Data

Aug. 18, 2000 (JP) ..... 2000-248454

(51) Int. Cl.[7] ..... D05B 19/12; D05B 21/00; D05C 5/04

(52) U.S. Cl. ..... 112/102.5; 112/470.04; 700/138

(58) Field of Search ..... 112/102.5, 470.04, 112/470.06, 470.01, 445, 456, 457, 458; 700/138

(56) References Cited

U.S. PATENT DOCUMENTS 5,299,519 A * 4/1994 Hirabayashi ..... 112/456
5,390,126 A * 2/1995 Kongho et al. ..... 700/138
6,119,611 A * 9/2000 Tomita ..... 112/470.04

* cited by examiner

*Primary Examiner*—Peter Nerbun
(74) *Attorney, Agent, or Firm*—Lowe Hauptman Gilman & Berner LLP

(57) ABSTRACT

A sewing machine and is connected to an external environment device having a display such that additional pattern information transmitted to the external environment device may be confirmed at the display irrespectively of internal and external information, the sewing machine having a memory for storing data which may be rewritten therein and an information input/output device for inputting and outputting external information into and from the memory such that the sewing machine may be operated under control of the external information while machine control information is outputted through the information input/output device.

3 Claims, 2 Drawing Sheets

SEWING MACHINE AND THE SYSTEM THEREOF

BACKGROUND OF THE INVENTION AND RELATED ART STATEMENT

1. Field of the Invention

The present invention relates to a sewing machine and the system thereof, and more particularly relates to operating the sewing machine under control of external information while machine control information is outputted.

2. Prior Art

According to the conventional sewing machine, a pattern to be stitched is optionally selected among a plurality of different patterns in reference to the pattern data or indication data which are stored in the sewing machine. It has been proposed that an external memory having pattern data stored therein is removably connected to the sewing machine so as to stitch new patterns. However, as the external memory has no indicating means such as a display, the machine user can not know the contents of the memory until the same is connected to the sewing machine. Further, the machine user has to know the contents of the internal and/or external memories at a limited area of display which is arranged in a limited space of the sewing machine frame and often fails to show thereat a sufficient amount of information as required by the user. Further, it has been proposed to read out the pattern data from a plurality of external memories, capacity of which is limited respectively, so as to form a pattern in combination of different patterns. In this case, at most two memories are allowed to be connected to the sewing machine. It has, therefore, been very troublesome to exchange the external memories in case the patterns to be combined are stored in many memories, for example, in more than four memories. Further, as an external environment means, a computer has been proposed to be connected to the sewing machine. This is, however, to simply give instructions on the basis of data and is not a part of sewing machine system for cooperating with the sewing machine. Namely, the computer fails to renew and indicate the content of control for the sewing machine.

OBJECTS OF THE INVENTION

The invention has been provided to eliminate the defects and disadvantages of the prior art. It is, therefore, a primary object of the invention to provide an external environment means having a display and connected to a sewing machine so as to enable a machine user to visually confirm, besides the limited area of machine frame, the information stored in the external memories as well as in the sewing machine and the information to be newly added.

It is another object of the invention to operate the sewing machine under control of the confirmed information which is transferred into a memory of the sewing machine.

It is another object of the invention to enable a machine user to visually confirm and memorize the contents of a plurality of external memories indicated at the display of the external environment means.

It is another object of the invention to provide an information input/output means for storing the external data stored in a plurality of external memories into a memory of a sewing machine.

It is another object of the invention to provide another information input/output means which may be connected to the first mentioned information input/output means during operation of the sewing machine so as to supply further new information to the sewing machine.

It is another object of the invention to control the information inputted and outputted by the information input/output means with the specific information specified by a user or machine operator.

It is another object of the invention to make the specific information include a plurality of information specified by a plurality of users or machine operators.

It is another object of the invention to specify the information inputted and outputted by said information input/output means in connection with the contents of stitching operation.

It is another object of the invention to specify the information inputted and outputted by said information input/output means in connection with a pattern or patterns to be stitched.

It is another object of the invention to provide a sewing machine system for renewing the data.

It is another object of the invention to provide a net work as an external environment so as to enable the machine user to obtain new information at a real time.

The other objects and advantages of the invention will be apparent in the detailed description of the invention.

SUMMARY OF THE INVENTION

For attaining the objects, the invention substantially comprises a vertically reciprocating needle and a mechanism for moving a work relative to the needle to form stitches on the work, the sewing machine comprising a first memory having pattern data and indication data stored therein, the pattern data and indication data being selectively recoverable, a second memory having a control system of a sewing machine stored therein, a third memory for storing at least one of pattern data, indication data and control data which may be rewritten therein, an information input/output means for inputting and outputting external information into and from the third memory, so that the sewing machine may be operated under control of external information while machine control information is outputted through the information input/output-means.

Further, the invention comprises a vertically reciprocating needle and a mechanism for moving a work relative to the needle to form stitches on the work, the sewing machine comprising a first memory having pattern data and indication data stored therein, said pattern data and indication data being selectively recoverable, a second memory having a control system of sewing machine stored therein, a third memory for storing at least one of pattern data, indication data and control data and data set by a user or machine operator which may be rewritten therein, an information input/output means for inputting and outputting external information into and from the third memory, so that the sewing machine may be operated under control of external information while machine control information is outputted through the information input/output means.

Further, the invention comprises a vertically reciprocating needle and a mechanism for moving a work relative to the needle to form stitches on the work, said sewing machine comprising a first memory having pattern data and indication data stored therein, the pattern data and indication data being selectively recoverable, a second memory having a control system of sewing machine stored therein, a third memory for storing at least one of pattern data, indication data and control data and data set by a user or machine operator, which may be rewritten therein, an information input/output means for inputting and outputting external information into and from the third memory, so that the sewing machine may be operated under control of external information while the data set by a user or machine operator is outputted through the information input/output means.

Further, the invention comprises a sewing machine having a vertically reciprocating needle and a mechanism for moving a work relative to the needle to form stitches on the work and an external environment means for maintaining the control environment of said sewing machine and giving instructions while exchanging information with said sewing machine, the sewing machine including a first memory having pattern data and indication data stored therein, the pattern data and indication data being selectively recoverable, a second memory having a control system of sewing machine stored therein, a third memory for storing at least one of pattern data, indication data and control data which may be rewritten therein, an information input/output means for inputting and outputting external information into and from the third memory, so that the sewing machine may be operated under control of external information, and so that the external environment means may output the control information from said third memory through the information input/output means.

DETAILED DESCRIPTION OF PREFERRED EMBODIMENTS

The invention will be described in detail in reference to the embodiment as shown in the attached drawings.

Figure 1:
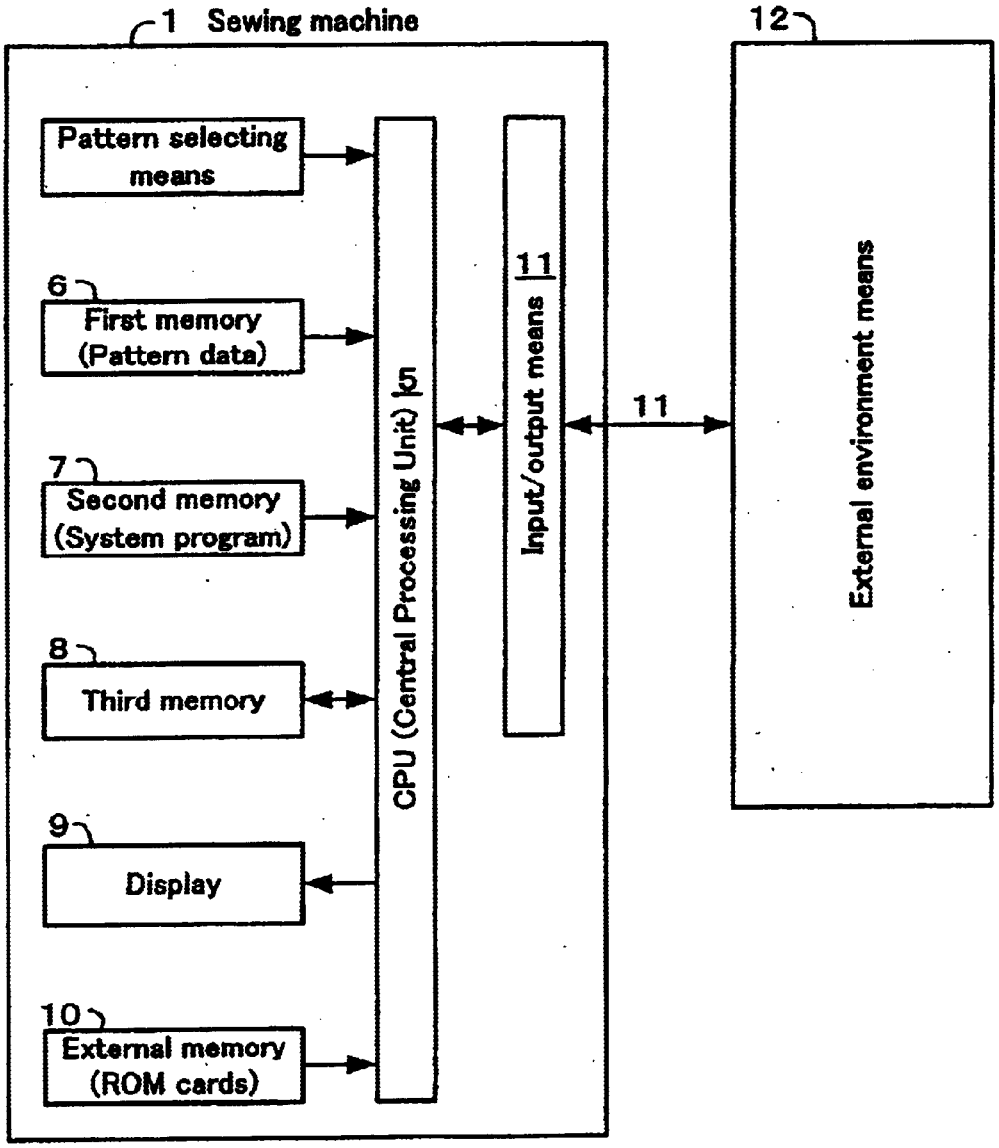
FIG. 1 is an explanatory view of an embodiment of a sewing machine according to the invention.
Figure 2:
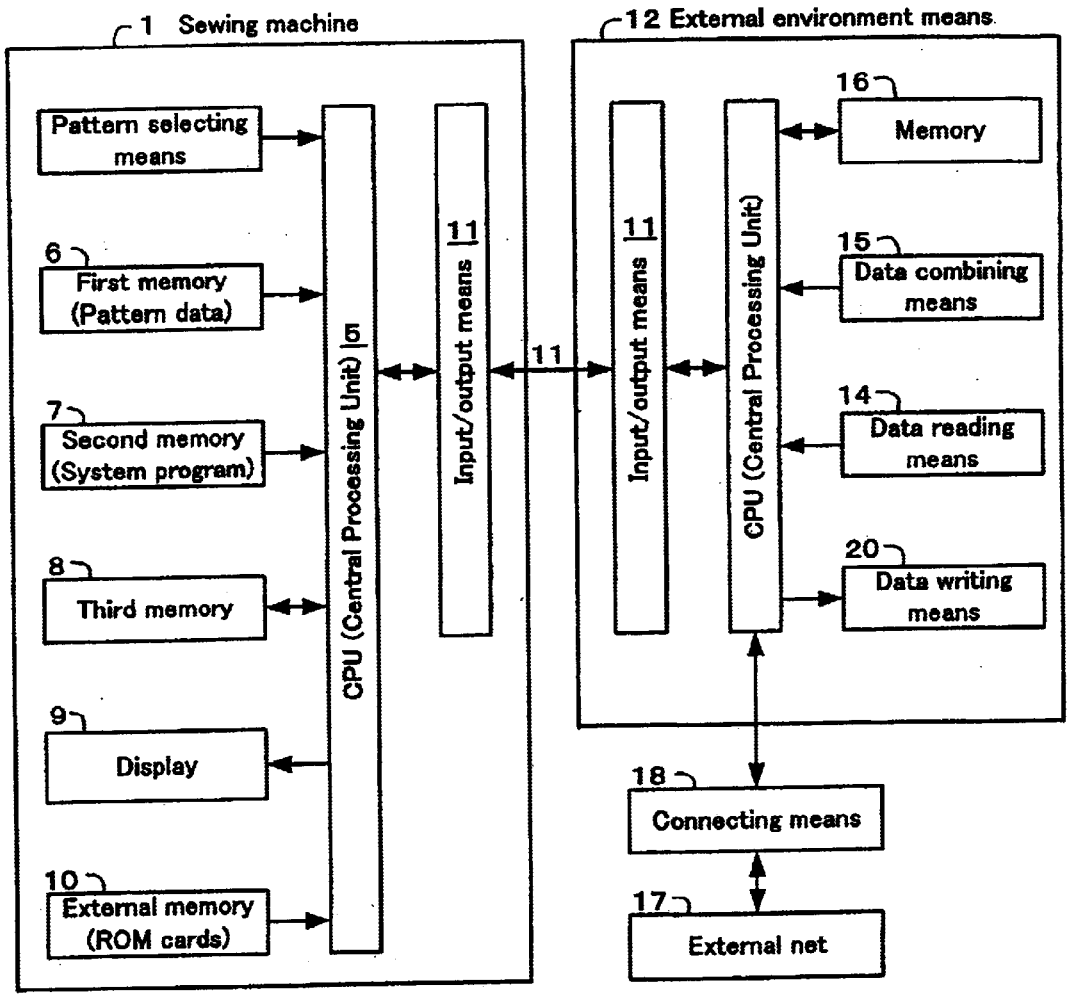
FIG. 2 is an explanatory view of an embodiment of a system of sewing machine according to the invention.

In FIG. 1 the reference numeral 1 represents a sewing machine 1 with an embroidery stitching function and the system thereof. The sewing machine is provided with CPU (Central Processing Unit) 5 having a drive motor (not shown), first and second control motors (not shown) connected thereto, the drive motor being provided to drive the sewing machine for stitching operation, first and second control motors being provided to control the movement of an embroidering frame in X-direction and Y direction respectively, the embroidering frame having a cloth held thereon to be stitched.

The reference numeral 6 denotes a first memory 6 having pattern data and indication data stored therein and connected to the CPU 5. The reference numeral 7 denotes a second memory having control system programs stored therein for controlling the operation, indication of the sewing machine and controlling the input and output of information and connected to the CPU 5. The reference numeral 8 denotes a third memory for storing as renewed at least one of the pattern data, the indication data and control data and connected to the CPU 5. The control data includes the contents for controlling the sewing machine and the data for registering the contents of indication and the initial conditions of the sewing machine selected by the user or machine operator and the conditions to be registered.

The reference numeral 9 denotes a display arranged at a front side of the sewing machine 1 for indicating thereat the pattern data and various messages and connected to the CPU 5.

The reference numeral 10 denotes a plurality of external memories which may be removably attached to the sewing machine 1. The memories 10 have stored therein a plurality of pattern data and indication data which are different from those stored in the first memory 6. The memories 10 may be selectively attached to the sewing machine and connected to the CPU 5. The memories 10 may have stored therein control programs in addition to the pattern data and indication data. The control programs may be memorized in the third memory 8 so as to change the contents of control.

The reference numeral 11 denotes an input/output means connected between the sewing machine 1 and an external environment means 12. Preferably, the input/output means may be removed while power is supplied in case the external environment means 12 is a personal computer. Precisely, the input/output means 11 is the USB by use of the USB cord.

Preferably, the external environment means 12 is a personal computer including a large sized indicating means (not shown), a data reading means 14, a combining means 15, a memory 16 for storing therein combined data and inputted data and a connecting means 18 for connecting the external environment means 12 to an external information net means 17. Preferably, the external information channel net means 17 is a public or personal channel including internet and cable.

Operation is as follows:

Power is supplied to the sewing machine 1 and the external environment means 12 to activate the same respectively, and the two members are connected to each other by the input/output means 11. The combinations of patterns incorporated in the sewing machine 1 are given the IDs and register numbers of users or machine operators and are stored in the third memory 8 and are further outputted to external environment means 12 to be stored in the memory 16. The contents stored in the memory 16 may be optionally read out to be used for stitching operation.

Further, the contents to be indicated at the display 9 of the sewing machine 1 and the size of indication and the color setting information may be stored in the third memory 8 and may be further outputted to the external environment means 12 to be stored in the memory 16. The contents stored in the memory 16 may be optionally read out. The contents of the machine control data may be changed or renewed by the control programs from the external memory 10 of the sewing machine 1 and/or from the external environment means 12. The prior contents before being changed or renewed may be recovered because the same may be stored in the memory 16 of the external environment means 12. The contents of data may be stored per pattern, per stitching operation, per user or per machine operator, and the stored contents may be optionally read out and transmitted to the sewing machine 1 to change or renew the setting contents of the sewing machine 1.

The contents of embroidery stitching operation, the contents of preparation for setting information, the contents of the next process, the information for time elapse, remaining time, finishing time, a finished pattern anticipated and so on may be indicated and confirmed at the display (not shown) of the external environment means 12 one after another in accordance with the information from the sewing machine side.

The contents of the plurality of external memories 10 may also be confirmed at the display (not shown) by way of the sewing machine 1 or by reading out the same by a data reading out means of the external environment means. Further, these contents of plural external memories may be held as indicated at a single display so that these may be selectively designated and so that, as to the designated patterns including specifically combined patterns, the pattern data and indication data may be transmitted to the sewing machine side with the selecting codes given thereto respectively, so as to be stored in the third memory 8. In this way, the contents of plural external memories 10 may be stitched without exchange of the external memories 10. Further, since the external environment means 12 is independent from the sewing machine 1, the contents to be subsequently stitched may be designated in combined arrangement.

Further, the sewing machine may be operated by the contents in specific combinations and compilations stored in the external memories 10 by use of the data writing means 20 of the external environment means 12 instead of using the connecting means 18.

Further, the sewing machine 1 may be operated under control of the external environment means 12.

Further, the embroidery stitching operation may be performed under control of the pattern data, indication data, control program data, combined data and so on which are stored in the memory 16 as downloaded from the external information channel net 17 through the connecting mans 18 and the external environment means 12 and transmitted to the sewing machine 1. In this connection, the download may be systematized to impose expense on the user in contract with an external information supplier on the basis of the content of information supplied and the number of times that the information is supplied.

As is apparent from the above description, according to the invention, an external environment means having a display may be provided in connection with the sewing machine to enable the machine user to confirm the information stored in the external memories as well as in the sewing machine, wherein a pattern or patterns in combination may be optionally compiled as partly deleted or added irrespectively of the pattern information stored in the sewing machine and in the external memories. Thus the confirmed pattern information may be transmitted to the sewing machine so that the sewing machine may be operated under control of the confirmed pattern information. Further according to the invention, the external environment means may be connected to an external information channel so that new information may be obtained at a real time:

The invention being thus described, it will be obvious that the same may be varied in many ways. Such variations are not to be regarded as a departure from the spirit and scope of the invention, and all such modifications are intended to be included within the scope of the following claims.

What is claimed is:

1. A sewing machine system, comprising:

a sewing machine having a vertically reciprocating needle and a mechanism for moving a workpiece relative to the needle to form stitches on the workpiece; and external environment means for maintaining the control environment of said sewing machine and giving instructions while exchanging information with said sewing machine;

said sewing machine including a first memory having pattern data and indication data stored therein, said pattern data and indication data being selectively recoverable, a second memory having a control system of said sewing machine stored therein, a third memory for storing at least one of said pattern data, said indication data, and control data, and information input/output means for inputting and outputting external information into and from said third memory, so that the sewing machine may be operated under control of said external information, and so that said external environment means may output the control data from said third memory through said information input/output means.

2. The sewing machine system as defined in claim 1, wherein said external environment means includes a computer system or a network system specified with a user or machine operator.

3. A sewing machine system, comprising:

a sewing machine having a vertically reciprocating needle and a mechanism for moving a workpiece relative to the needle to form stitches on the workpiece; and external environment means for maintaining the control environment of said sewing machine and giving instructions while exchanging information with said sewing machine;

said sewing machine including a first memory having pattern data and indication data stored therein, said pattern data and indication data being selectively recoverable, a second memory having a control system of said sewing machine stored therein, a third memory for storing at least one of said pattern data, said indication data, and control data, and information input/output means for inputting and outputting external information into and from said third memory, so that the sewing machine may be operated under control of said external information, and so that said external environment means may output the control data from said third memory through said information input/output means;

wherein said external environment means includes a network system for imposing expense on a user or machine operator in contract with an external information supplier on the basis of the content of information supplied and the number of times that the information is supplied.

* * * * *